United States Patent [19]

Hogue

[11] 4,199,887

[45] Apr. 29, 1980

[54] ONE PIECE HAND GRIP FOR PISTOL

[76] Inventor: Guy Hogue, 14540 Old Morro Rd., Atascadero, Calif. 93422

[21] Appl. No.: 954,205

[22] Filed: Oct. 23, 1978

Related U.S. Application Data

[63] Continuation of Ser. No. 836,156, Sep. 23, 1977, abandoned.

[51] Int. Cl.[2] ..... F41C 23/00

[52] U.S. Cl. ..... 42/71 P

[58] Field of Search ..... 42/71 P

[56] References Cited

U.S. PATENT DOCUMENTS

| | | | |
|---|---|---|---|
| 1,228,506 | 6/1917 | Wesson | 42/71 P |
| 1,279,372 | 9/1918 | Lempie | 42/71 P |
| 1,898,368 | 2/1933 | Hess et al. | 42/71 P |
| 2,034,632 | 3/1936 | Rice | 42/71 P |
| 2,744,448 | 5/1956 | Allen | 42/71 P |
| 3,367,053 | 2/1968 | Lewis | 42/71 P |
| 3,683,535 | 8/1972 | Lewis | 42/71 P |

*Primary Examiner*—Charles T. Jordan

*Attorney, Agent, or Firm*—Brown & Martin

[57] ABSTRACT

A one piece hand grip to fit over the butt portion of a pistol frame to provide a comfortable contoured grip which will not work loose during prolonged firing. A single fastener secures the hand grip, which is adaptable to many existing pistols and is designed to seat securely on the frame of the particular pistol.

8 Claims, 9 Drawing Figures

ONE PIECE HAND GRIP FOR PISTOL

This is a continuation of application Ser. No. 836,156, filed Sept. 23, 1977, now abandoned.

BACKGROUND OF THE INVENTION

In most hand guns the hand grip is formed by a pair of shaped side plate grip elements secured on opposite sides of the butt portion of the frame. The grip elements are usually secured by a screw extending between the plates through the open frame, with small pins inset in the frame to align the two grip portions. In prolonged use, particularly with large caliber weapons, the grips tend to work loose due to the repeated recoil action against the hand. The recoil force is backward and upward, while the hand attempts to hold the weapon in place, resulting in a twisting force between the frame and the grip elements. Even a very slight and often unnoticeable shift or looseness of the grips can interfere with precise shooting.

SUMMARY OF THE INVENTION

The hand grip described herein is a one piece element shaped to fit closely over the butt portion of a pistol frame, enclosing both sides, the front and the base or foot of the butt portion. A single fastener through the base or shoe of the grip secures the grip to the foot of the frame, the grip being locked against twisting or other displacement by its internal shaping to fit the frame structure. The front portion of the grip interconnecting the sides is shaped to fit the user's hand, providing a comfortable and secure grip.

Several types of fasteners are shown to adapt to variety of pistols and make the grip attachment simple and convenient. In most instances, no modification to the pistol frame will be necessary.

The primary object of this invention, therefore, is to provide a new and improved one piece hand grip for a pistol.

Another object of this invention is to provide a one piece hand grip which is secured by a single fastener, but which will remain securely locked in place during prolonged use.

A further object of this invention is to provide a one piece hand grip which is adaptable to many different types of pistols with little or no modification to the pistol structure.

Other objects and advantages will be apparent in the following detailed description, taken in conjunction with the accompanying drawings, in which.

DESCRIPTION OF THE PREFERRED EMBODIMENT

Figure 1:
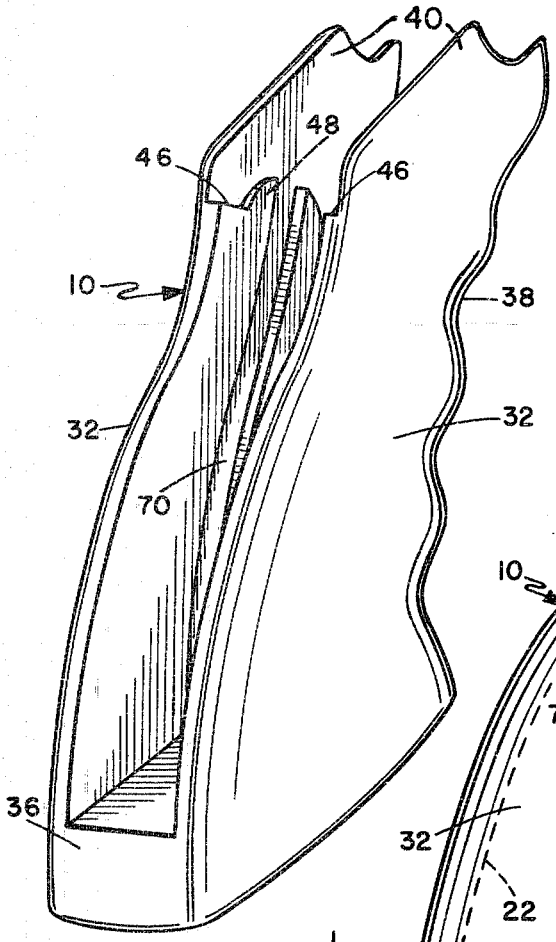
FIG. 1 is a perspective view of the one piece grip.

The grip 10 is shown attached to a conventional revolver 12, having a frame 14 with a butt portion 16. The butt portion is cut out for lightness and to accommodate the firing spring used in most pistols, leaving a base or foot 18 interconnecting the front and rear portions 20 and 22 of the butt structure. At the upper end of the butt the frame has a thickened portion 24 to contain the trigger and hammer mechanism. This provides shoulders 26 against which the usual individual side plates abutt, each shoulder commonly having a socket 28, or similar shaped portion, into which the side plate seats for alignment. The specific configuration may vary, the arrangement shown in FIG. 1 being typical.

The conventional side plates are usually secured by a screw between the plates, passing through the open portion of the butt. An alignment pin, fitted through a pin hole 30 in foot 18, holds the lower ends of the side plates. The pin is not required for the one piece grip, but the pin hole 30 may be used for certain types of fasteners.

Grip 10 has sides 32 joined at the front by a front portion 34 and at the lower end by a shoe 36. The unitary structure may be carved from wood, or molded from plastic or other suitable material. Front portion 34 is shaped to provide finger recesses 38 which extend into the sides, and may be made to fit an individual hand. Shoe 36 seats firmly up against foot 18 and extends the hand grip below the butt portion of the frame. The extended and thickened grip, with shaping to fit the hand, results in a very comfortable and secure grip for any caliber of pistol.

The upper ends of sides 32 have extensions 40 which are undercut to fit over the thickened frame portion 24, and are shaped to fit the particular cylinder 42 and trigger guard 44. These side extensions provide body for the wrap-around of the thumb and trigger finger at the top of the grip. The undercutting leaves shoulders 46 in the sides, which butt against the frame shoulders 26, the sides also having plug portions 48 to fit into sockets 28 and hold the grip securely in alignment.

Figure 2:
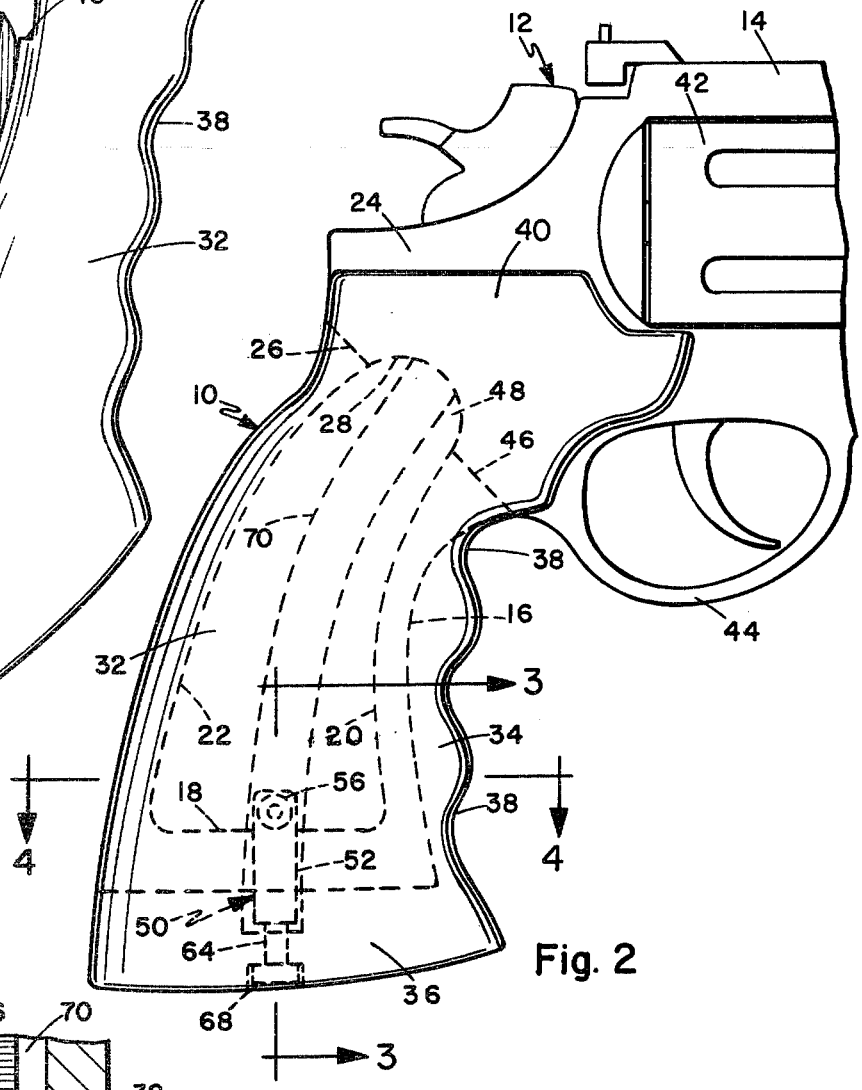
FIG. 2 is a side elevation view of a typical revolver with the grip attached.
Figure 3:
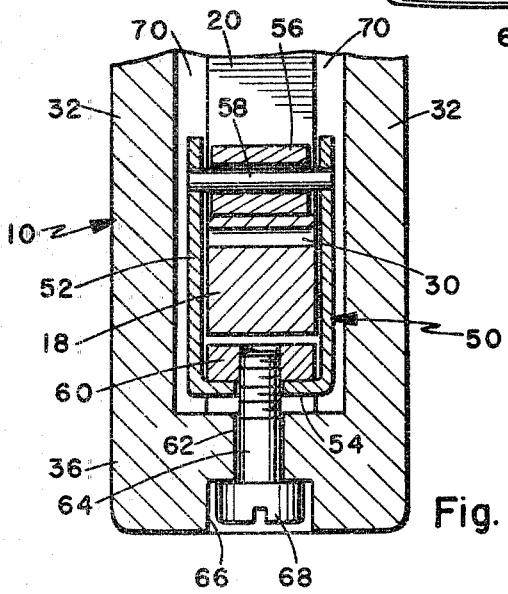
FIG. 3 is an enlarged sectional view taken on line 3—3 of FIG. 2.
Figure 4:
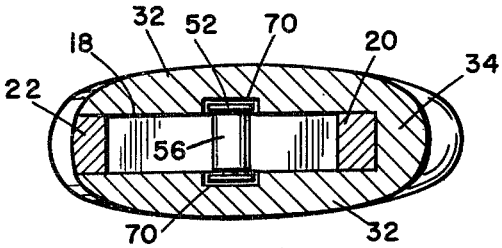
FIG. 4 is a sectional view taken on line 4—4 of FIG. 2.

One preferred form of fastener 50 is shown in FIGS. 2–4. This fastener comprises a yoke 52 which straddles foot 18 from below and has a lower cross bar 54. A roller 56 is rotatably mounted on a pin 58 between the upper ends of yoke 52 and rolls on the top surface of foot 18. A nut 60 is secured in any suitable manner to cross bar 54 inside the yoke.

Shoe 36 has a bore 62 extending vertically to receive a screw 64, the lower end of the bore having a counterbore 66 to enclose the screw head 68. Screw 64 is threaded into nut 60 and tightened to pull the grip 10 firmly up against the butt 16. The roller mounting of fastener 50 allows the fastener to position itself along foot 18 to suit any screw position. To align the fastener the sides 32 have internal channels 70 to provide clearance for the yoke 52. Channels 70 extend from plug portions 48 into the shoe 36, so that as grip 10 is slid upwardly on to the butt 16, the channels slide over and align the yoke 52 to the proper screw receiving position.

Figure 5:
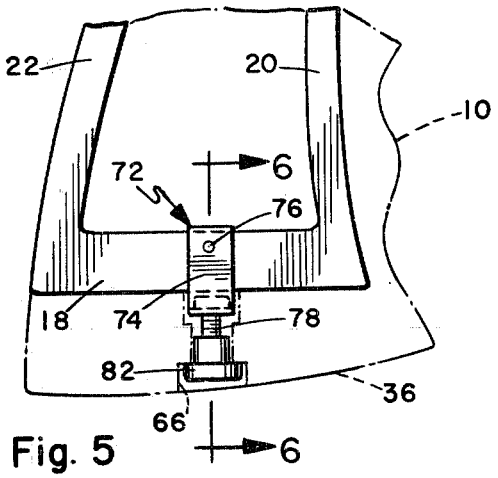
FIG. 5 is a side elevation view of a portion of the revolver frame, showing an alternative grip attachment bracket.
Figure 6:
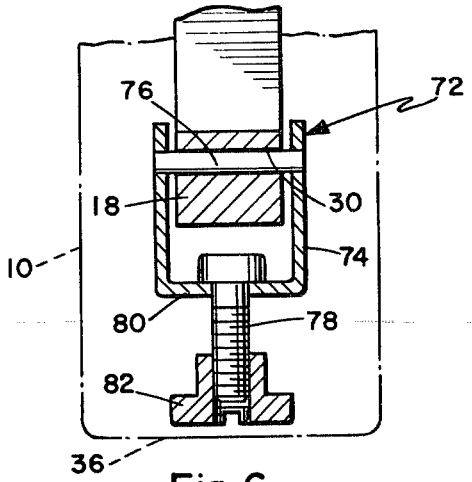
FIG. 6 is an enlarged sectional view taken on line 6—6 of FIG. 5.

An alternative fastener 72 is illustrated in FIGS. 5 and 6, the fastener having a yoke 74 which straddles foot 18 as before. In this instance, however, the yoke is secured by a retaining pin 78 through the pin hole 30 in the foot. A screw 78 passes downwardly through the cross bar 80 of yoke 74 and the grip is secured by a nut 82 set in counterbore 66. Fastener 72 is not adjustable along foot 18, so the channels 70 in the grip would be positioned to suit the fastener.

Figure 7:
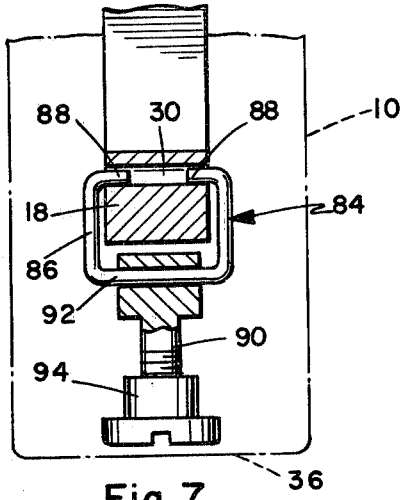
FIG. 7 is a similar sectional view showing an alternative attachment bracket.

A further fastener 84 utilizing pin hole 30 is shown in FIG. 7. In this configuration the yoke 86 is bent from wire and has inwardly turned retaining pins 88 which fit into pin hole 30. A screw 90 is attached to the cross bar 92 of yoke 86 and the grip is secured by a nut 94.

Figure 8:
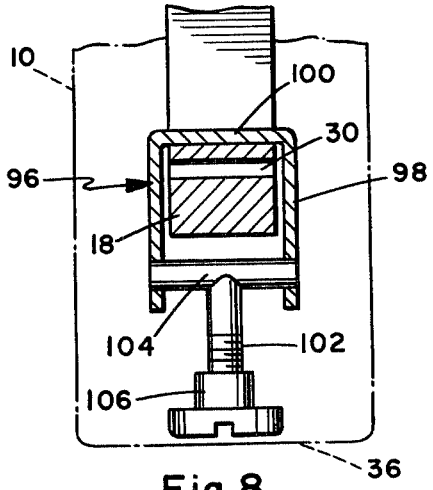
FIG. 8 is a similar sectional view showing a further type of attachment bracket.

FIG. 8 illustrates another adjustable fastener 96, having a yoke 98 which straddles the foot 18 downwardly, with a connecting bar 100 resting on top of the foot. A screw 102 extends from a cross bar 104 between the lower ends of yoke 98 and the grip is held by a nut 106.

Figure 9:
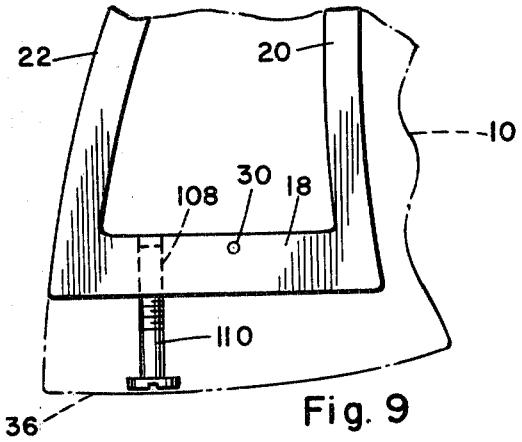
FIG. 9 is a view similar to FIG. 5, showing an alternative grip attachment.

A fastener which requires slight modification to the pistol frame is shown in FIG. 9. A threaded hole 108 is provided through the foot 18, preferably toward the rear so as not to obstruct the serial number which is usually stamped in the foot. The grip is then held in place by a screw 110 directly into the threaded hole 108.

Other variations of fasteners may be used, including quick lock and release types, but in each instance the one piece grip is clamped upwardly against the butt. The internal shaping of the grip and its almost complete enclosure of the butt ensure a secure grip during prolonged use.

Having described my invention, I claim:

1. A one piece hand grip for a pistol having a frame with a hand receiving butt, the butt having a front portion, a rear portion and a lower interconnecting foot, the upper end of the butt having a thickened portion defining shoulders in the frame, the hand grip comprising:

a unitary grip member having a pair of sides, an interconnecting front portion and an interconnecting lower shoe, said grip being internally shaped to fit closely over said butt enclosing the sides and front thereof, with said shoe seated against the foot;

fastener means extending through said shoe and engaging said foot to secure the grip with an upward clamping action against the foot;

and said fastener means includes yoke means straddling the foot and having a cross bar portion below the foot, and a fastener extending through said shoe and connected to said cross bar portion.

2. A one piece hand grip according to claim 1, wherein said sides have extensions fitting over the thickened portion of the butt, said extensions being internally undercut and defining shoulders in the grip which abutt the shoulders of the frame.

3. A one piece hand grip according to claim 1, wherein said sides have an internal channel for receiving said yoke.

4. A one piece grip according to claim 1, wherein said yoke has a connected upper bar that abutts against the top of said foot.

5. A one piece grip according to claim 1, wherein said fastening means is a screw means.

6. A one piece hand grip according to claim 1, wherein said yoke has a roller rotatably mounted therein and riding on top of said foot, whereby the fastener is adjustable along the foot.

7. A one piece hand grip according to claim 1, wherein said foot has a pin hole therethrough, said yoke having a retaining pin extending into the pin hole.

8. A one piece hand grip according to claim 2, wherein the shoulders of said frame have sockets therein, the shoulders of said grip having corresponding plug portions to seat in the sockets.

* * * * *